US005753838A

United States Patent [19]

Vanga, II

[11] Patent Number: 5,753,838

[45] Date of Patent: May 19, 1998

[54] GUITAR STRING HOLDER

[76] Inventor: Val George Vanga, II, 17775 Main St., Irvine, Calif. 92714

[21] Appl. No.: 560,580

[22] Filed: Nov. 20, 1995

[51] Int. Cl.[6] ..... G10D 3/00; G10D 3/10

[52] U.S. Cl. ..... 84/297 R; 84/298; 84/299

[58] Field of Search ..... 84/297 R, 298–299, 84/314 N, 300–302

[56] References Cited

U.S. PATENT DOCUMENTS

| | | | |
|---|---|---|---|
| 568,108 | 9/1896 | Brown . | |
| 582,030 | 5/1897 | Walker . | |
| 668,060 | 2/1901 | Shelton . | |
| 1,253,550 | 1/1918 | Wilkins . | |
| 1,317,830 | 10/1919 | Sivard . | |
| 2,309,082 | 1/1943 | Smith et al. . | |
| 3,191,480 | 6/1965 | Lowe . | |
| 3,447,411 | 6/1969 | Bloxsom, Jr. . | |
| 3,486,408 | 12/1969 | Gross | 84/267 |
| 4,798,119 | 1/1989 | Leifheit . | |

*Primary Examiner*—William M. Shoop, Jr.
*Assistant Examiner*—Marlon T. Fletcher
*Attorney, Agent, or Firm*—Price, Gess & Ubell

[57] ABSTRACT

The guitar string holder can effectively convert a twelve-string guitar into either a six-string guitar or a Nashville guitar by lowering six of the twelve strings below the operative plane. The base of the guitar string holder fits onto the body or through a slot in the top of the guitar for solid top designs, or fits into the sound hole and is held upward against braces located beneath the top surface of the guitar. Alternatively, the guitar string holder can be slid onto opposing edges of the sound hole. When the base is slid onto opposing edges of the sound hole, a frictional fit is achieved and wood screws are not needed. Six arms extend from the base of the guitar string holder and accommodate corresponding hooks. Each hook can hold one of the guitar strings beneath the operative plane. It is also possible to use the guitar string holder to hold selected strings, to thereby provide a standard six-string guitar and a Nashville guitar pretuned to different open tunings.

20 Claims, 6 Drawing Sheets

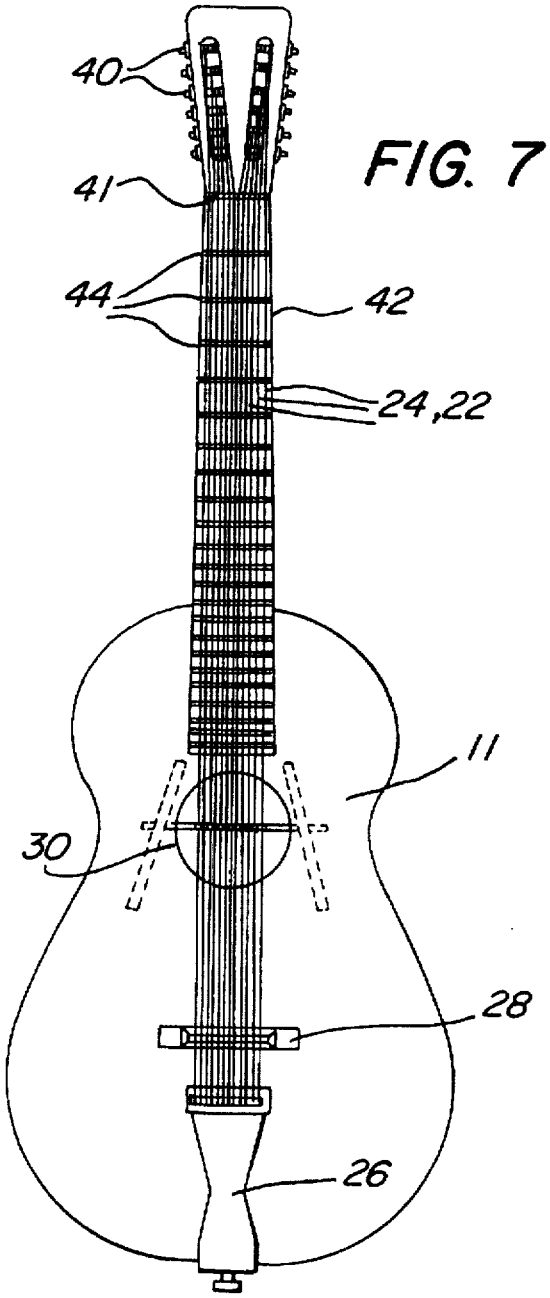
FIG. 7
FIG. 8
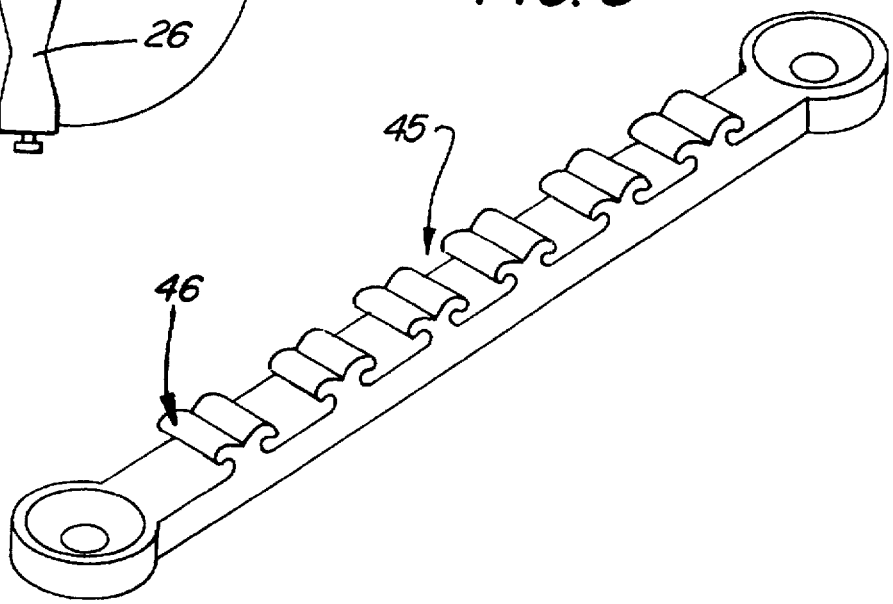

GUITAR STRING HOLDER

BACKGROUND OF THE INVENTION

1. Field of the Invention

The present application relates generally to musical instruments and, more particularly, to guitar string holders for holding selected guitar strings below the operative range of a user's pick.

2. Description of Related Art

Many apparatuses have been developed in the prior art for shortening or lengthening the speaking length of a string of a musical instrument. U.S. Pat. No. 582,030 to Walker discloses a tuning bar having four slots for receiving four of the five banjo strings. The speaking length of each of the banjo strings is terminated at the block by insertion of the respective banjo string into a slot. The fifth string is received in a smaller block which has only one slot. According to the invention of Walker, each of the blocks can be moved within respective slots in the neck of the banjo to change the tuning of the banjo strings. Another invention by Shelton, U.S. Pat. No. 668,060, discloses a guitar or violin having finger boards which include longitudinal strips and slots therebetween. Pins are slidable in the slots. Each of the strings can be hooked onto an associated pin to change the speaking length of the respective string.

Wilkins, U.S. Pat. No. 1,253,550, discloses a string-sharpening fret pin located beside each string of the musical instrument. Each fret pin comprises a fret that is movable into and out of contact with the string via a hook. The assembly can selectively shorten and lengthen the speaking length of each of the strings. Sivard, U.S. Pat. No. 1,317,830, discloses blocks which are permanently mounted in the finger board of a guitar. A string is passed beneath each of the blocks to thereby fix the speaking length of the respective string. Lowe, U.S. Pat. No. 3,191,480, disclosed a movable stop for the fifth string of a banjo. The stop has an opening through which a string can be fed, and is moved up and down the fret board to change the speaking length of the string. The stop is attached to the fret board by a shank which is hooked into keyhole slots in the fret board.

Leifheit, U.S. Pat. No. 4,798,119, discloses a guitar having round-headed machine screws located between the frets of the fret board. Each machine screw is screwed at an angle into the fret board. The V-shaped notch between the bottom of the machine screw head and the shaft of the machine screw hooks the guitar string to fret that guitar string at that position.

None of the above-mentioned references provide means for moving selected guitar strings in and out of an operative range of the user's pick. Smith et al., U.S. Pat. No. 2,309,082, discloses a nut having upper string-supporting notches to allow the guitar to be played in the Hawaiian style and lower string-supporting notches to convert the guitar to the Spanish style of playing. Thus, the nut of Smith et al. moves all of the guitar strings between two operative ranges of the user's pick. By moving all of the guitar strings between two operative ranges, this apparatus can convert a six-string guitar between a Hawaiian style and Spanish style guitar.

Bloxsom, U.S. Pat. No 3,447,411, discloses a stringed musical instrument. This stringed musical instrument is without frets and has a minimum of seven strings operatively associated with a resonator. The remainder of strings can be selectively muted by locking the mid portion of the longer end of the string out of the normal strumming plane. According to Bloxsom, the large number of sympathetic strings provides additional tone power and an enhanced overtone capability. The means for muting out one or more selected strings provides for striking contrasts and adds an element of surprise. The muting means of this musical instrument is disclosed only in combination with the 38-stringed musical instrument. Bloxsom does not mention any possibility of muting strings of a regular guitar.

Moreover, none of the prior art references recognize the possibility of muting selected strings from a guitar to thereby change the characteristics of the guitar. Nor do any of the prior art references recognize a possibility for converting a twelve-string guitar into a six-string guitar or a Nashville guitar by selectively muting alternative guitar strings of the twelve-string guitar. In addition, it can be used to create unique guitars by muting any strings required. Instead of converting a twelve-string guitar into either a six-string or a Nashville guitar, the prior art generally relied on having two separate guitars (or two separate guitar necks), one a twelve-string, and one a six-string, for generating music corresponding to the different stringed guitars.

OBJECTS AND SUMMARY OF THE INVENTION

The present guitar string holder can be conveniently and removably affixed to a regular guitar in order to change the number of strings in the operative plane of the guitar. This guitar string holder operates in combination with a guitar having a neck and a plurality of keys at the distal end of the neck for tuning. Frets are positioned on the neck for allowing the user to change the speaking lengths of the guitar strings. A body having a tailpiece for holding the guitar strings in a bridge for elevating the guitar strings into an operative plane about the body is also incorporated. The guitar has a sound hole located on the body beneath a section of the guitar strings and a guitar string holder positioned on the body approximately adjacent to the sound hole. This device can also be used on solid top guitars by mounting on the top guitar surface, or through a slot in the top of the guitar surface from underneath in the manufacturing process. The guitar string holder is secured to the body of the guitar beneath the operative plane of the guitar strings and comprises a number of hooks for holding a corresponding number of the guitar strings beneath the operative plane.

The guitar string holder can effectively convert a twelve-string guitar into either a Nashville guitar or a six-string guitar by lowering six of the twelve strings below the operative plane. The base of the guitar string holder fits onto the body or through a slot in the top of the guitar for solid top designs, or fits into the sound hole and is held upward against braces located beneath the top surface of the guitar. When the base is slid onto opposing edges of the sound hole, a frictional fit is achieved and wood screws are not needed. Six arms extend from the base of the guitar string holder and accommodate corresponding hooks. Each hook can hold one of the guitar strings beneath the operative plane.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 7 shows another embodiment of the guitar string holder of the present invention attached within a sound hole of a guitar;

FIG. 8 shows the guitar string holder according to a further alternative embodiment;

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically.

Figure 1:
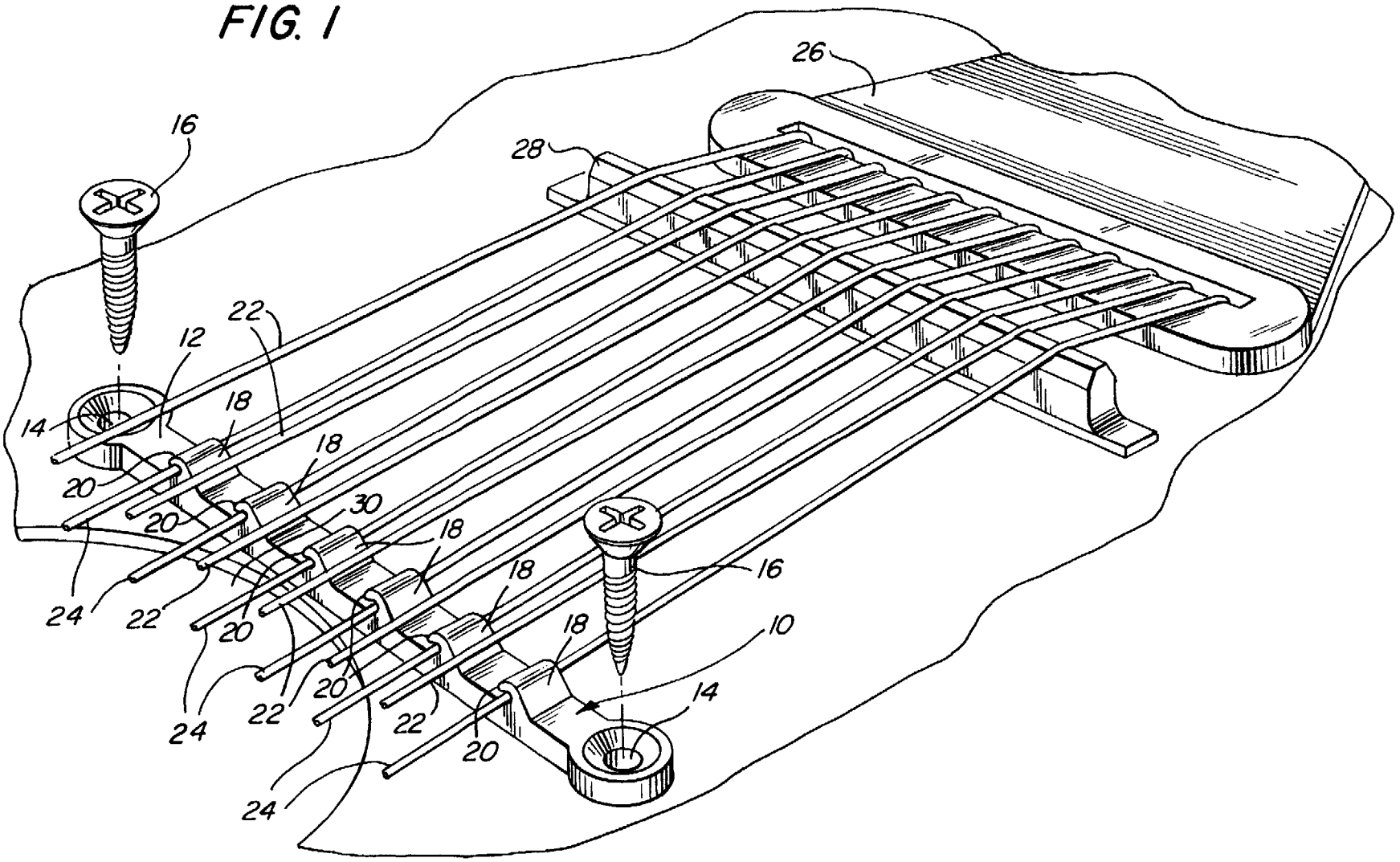
FIG. 1 is a top planar view of the guitar string holder of the present invention.

One example of a guitar string holder 10 of the present invention is shown in FIG. 1 holding six guitar strings 24 below an operative range of a player's pick or fingers. Another six guitar strings 22 remain in the operative range and can be strummed by a user's pick or fingers. Each of the guitar strings 24 held beneath the operative range of the user's pick is an alternative one of the original twelve guitar strings.

The guitar string holder 10 comprises a base 12 which is secured to the body of the guitar. The base 12 includes apertures 14 for accommodating wood screws 16. The wood screws 16 fit within the apertures 14 and can be secured into the body of the guitar.

Figure 2:
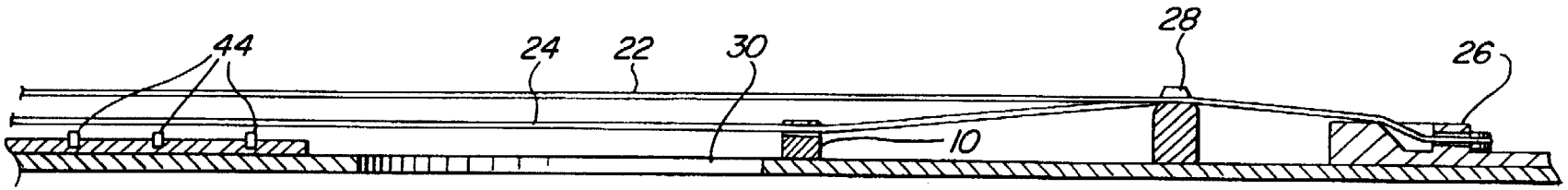
FIG. 2 is a perspective view of the guitar string holder of the present invention.

The guitar string holder 10 is shown in FIG. 2 located between the bridge 28 and the sound hole 30 of a conventional twelve-string guitar. As shown in FIG. 2, the six guitar strings 24 are held beneath the operative range of the user's pick, and the six remaining guitar strings 22 remain in the operative range of the user's pick. The user can strum the six guitar strings 22 to effectively achieve music corresponding to a six-string guitar. Each of the six guitar strings 24 held beneath the operative range of the user's pick is held by a corresponding hook 20 of the guitar string holder 10. Each hook 20 is secured to the base 12 of the guitar string holder 10 by a corresponding arm 18. The hooks may also point in a direction opposite to that shown in FIG. 1. The hooks 20 can have a curvilinear configuration. The base 12 and hooks 20 can be cast from a metal or other suitable material such as certain plastic resins. The hooks 20 can be spaced to match the string displacement for a particular musical instrument.

Figure 3:
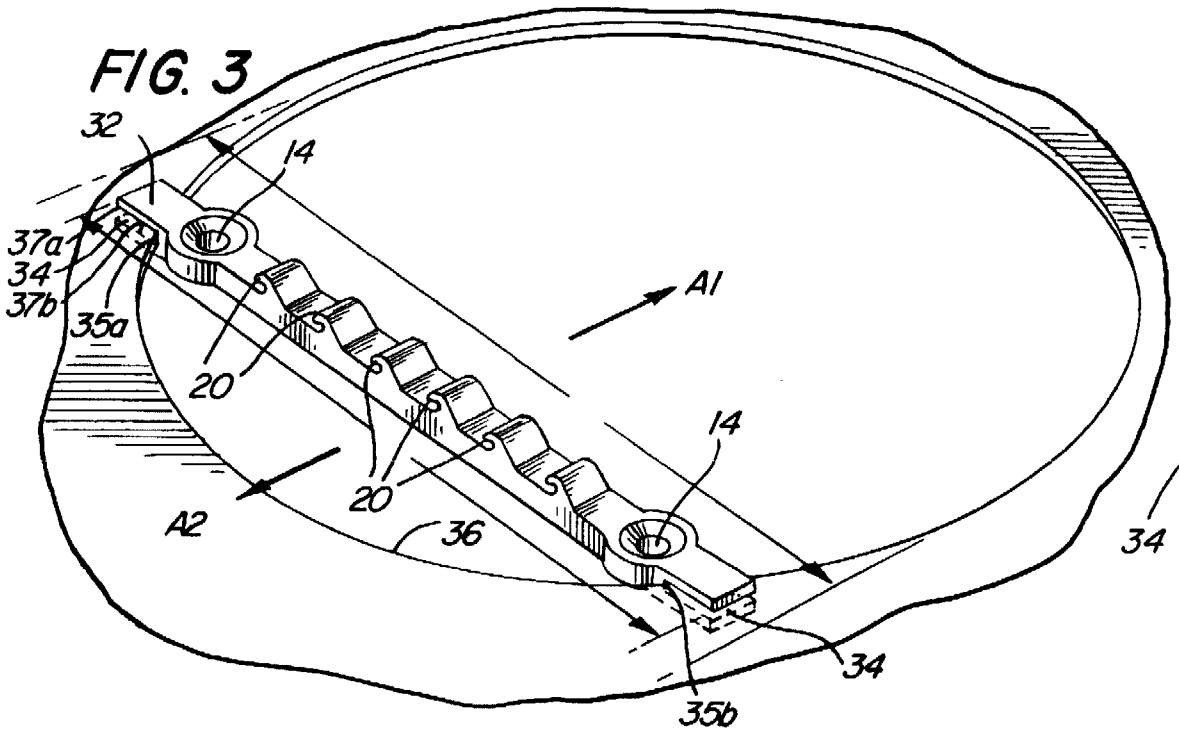
FIG. 3 shows a guitar string holder according to an alternative embodiment of the present invention.

Another embodiment is shown as a guitar string holder 32 in FIG. 3. This guitar string holder 32 comprises apertures 14 for securing the guitar string holder 32 to the body of the guitar, similarly to the embodiment shown in FIGS. 1 and 2. The alternative guitar string holder 32 further comprises channels 34 located at opposing ends of the guitar string holder 32. According to this alternative embodiment, the guitar string holder 32 can be placed into the sound hole 30 and slid in a direction perpendicular to a line through the hooks 20 until the two channels 34 come into frictional contact with the edge 36 of the sound hole 30. Thus, the guitar string holder 32 shown in FIG. 3 can be placed into the sound hole 30 and slid either in the direction of arrow A1 or in the direction of arrow A2. The guitar string holder of FIG. 3 has been slid in the direction of arrow A2 until each of the channels 34 has surrounded a corresponding area **35*a* and 35*b* of the edge 36 of the sound hole 30**.

The guitar string holder of the present invention is preferably formed of aluminum, although other materials may be used. Rubber tabs or other lining may be placed within the channels 34 to provide friction and protect the edges **35*a* and 35*b*. The frictional and protective material within channel 34 may comprise rubber, for example, placed on opposing edges 37*a* and 37*b***.

Figure 4:
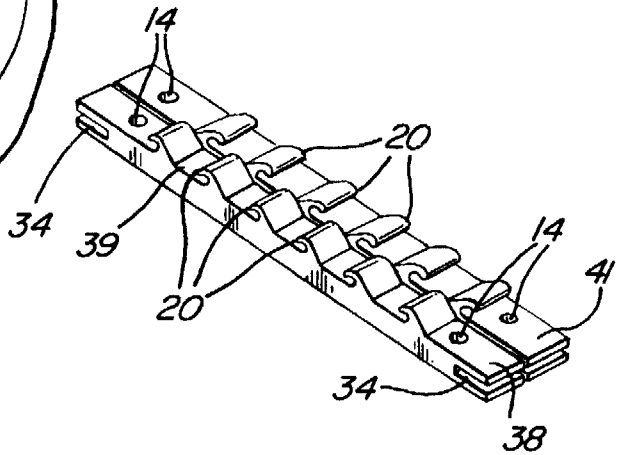
FIG. 4 shows a pair of guitar string holders according to a second alternative embodiment of the present invention.

FIG. 4 shows a guitar string holder 38 according to a second alternative embodiment. The guitar string holder 38 may comprise apertures 14 for accommodating wood screws 16, and further may comprise channels 34 for fitting around edges **35*a*, 35*b* of a sound hole 30. This second alternative embodiment may be formed by an extrusion technique. It is noted that the embodiment of FIG. 1 may be formed with channels 34, apertures 14, or any combination thereof. Moreover, the embodiments of FIGS. 3 and 4 may also be formed with any combination of channels 34 and apertures 14. The guitar string holder 38 has a generally rectangular configuration. The top surface 39 of the guitar string holder 38 comprises apertures 14 and hooks 20**.

Hooks 20 may comprise any structure for pulling corresponding guitar strings down towards the guitar string holder 38. This is also true for other disclosed embodiments of the present invention.

In FIG. 4, another guitar string holder 41 is shown positioned adjacent to guitar string holder 38. As presently embodied, the guitar string holder 41 is identical to the guitar string holder 38. The generally rectangular configuration of the two guitar string holders 38 and 41 allow the two guitar string holders to be positioned flush to one another. FIG. 8 shows the equivalent of the two guitar string holders of FIG. 4 merged into a single guitar string holder 45. The hooks 46 have a gull-wing cross-sectional configuration. Other embodiments of guitar string holders, such as those disclosed in FIGS. 1–3, may similarly be positioned adjacent to one another, but only portions surrounding apertures 14 of the two guitar string holders would contact one another.

An advantage for placing two guitar string holders adjacent to one another is that the hooks 20 of each guitar string holder are additive in nature. That is, the six hooks of guitar string holder 38 may selectively hold any of six guitar strings, and the six hooks 20 of guitar string holder 41 may selectively hold the remaining six guitar strings. Thus, two guitar string holders adjacently positioned effectively allow a user to hold any combination of the twelve guitar strings down beneath the operative range to create unique sounds, effects, or instruments. Another embodiment of the present invention may comprise a different number of hooks attached to a guitar string holder, according to preference.

Figure 5:
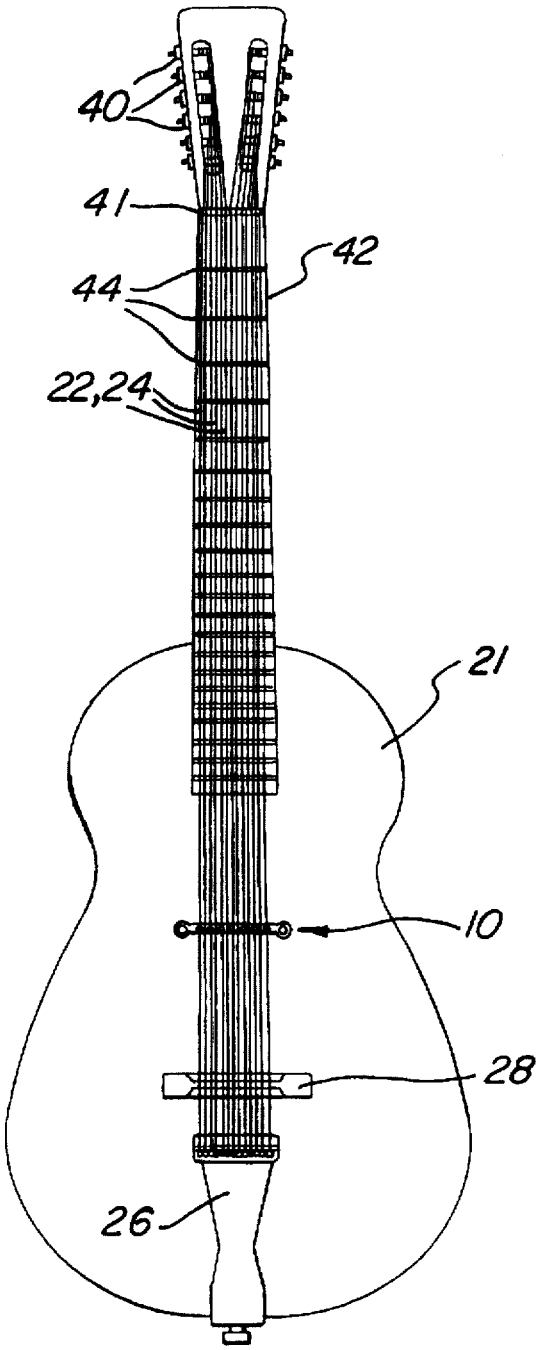
FIG. 5 shows the guitar string holder of the present invention attached to a twelve-string guitar.

Turning to FIG. 5, the guitar string holder 10 of FIG. 1 is shown secured to a surface of a solid guitar body 21. The keys 40 hold the guitar strings 22 and 24 on the neck 42. A nut 41 elevates and spaces the guitar strings 22 and 24. The strings 22, 24 may be depressed against frets 44 for changing the speaking lengths of the strings 22, 24. The tail piece 26 of the guitar body 21 holds the strings 22, 24, and bridge 28 elevates and separates the strings 22, 24. As previously described, the guitar string holder 10 can selectively remove any of guitar strings 22, 24 from the operative range of the user's pick.

Figure 6:
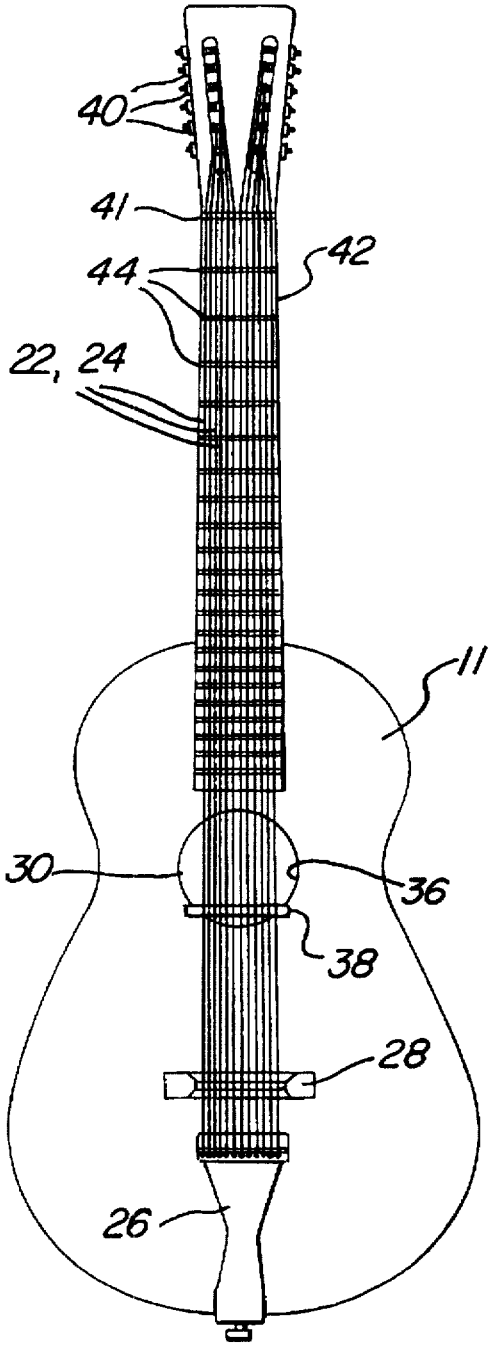
FIG. 6 shows the guitar string holder according to an alternative embodiment attached to a guitar.

FIG. 6 shows a guitar string holder 38 having channels 34 fitting around edges 36 of the sound hole 30. The guitar string holder 10 of FIG. 1 could be fabricated with channels 34 to fit in the position shown in FIG. 6 or, alternatively, the guitar string holder of FIG. 4 could be secured as shown in FIG. 6.

Figure 9:
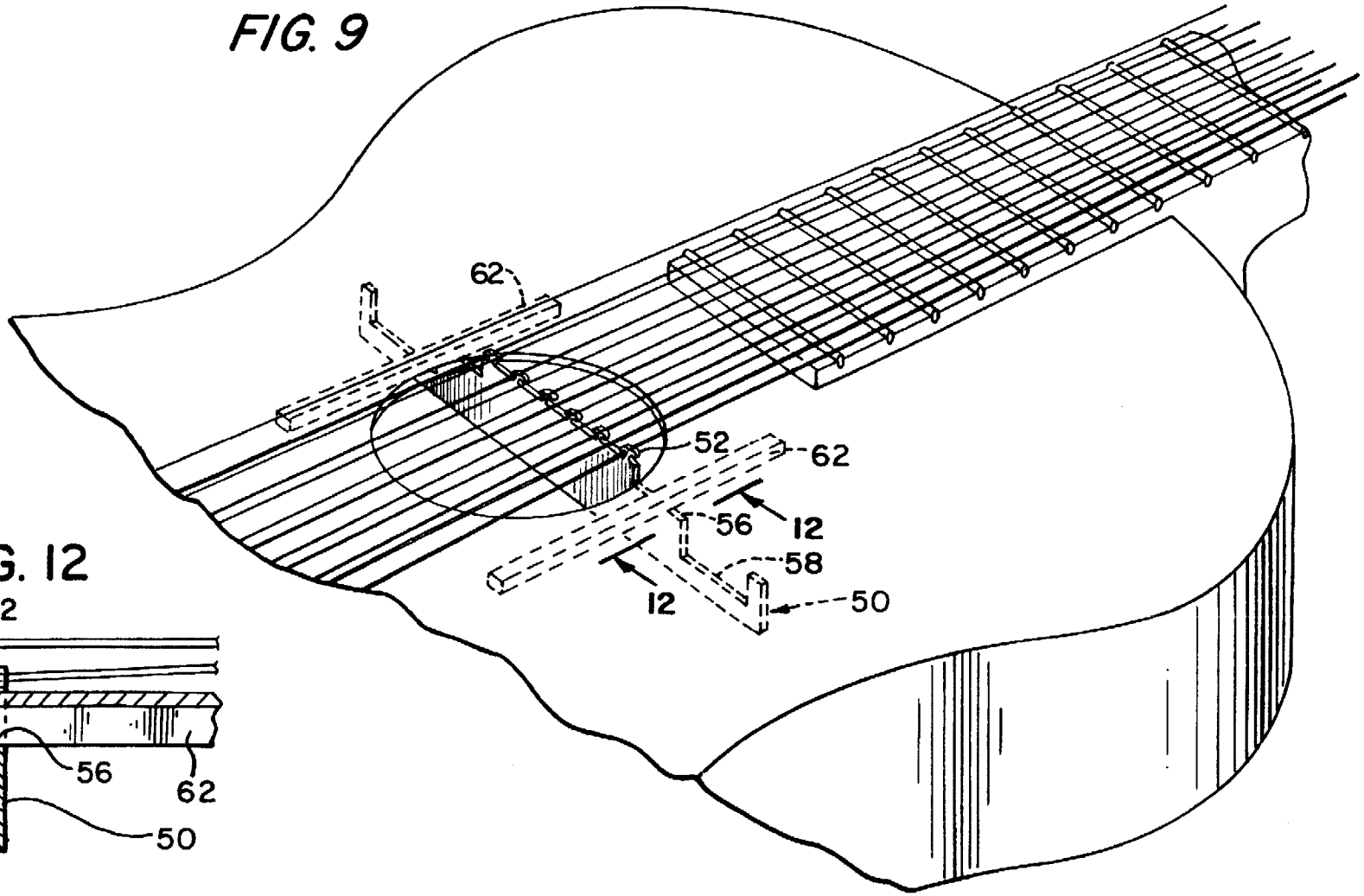
FIG. 9 shows a perspective mounting of a guitar string holder of FIG. 7.

FIG. 9 is a plan view of another embodiment of a guitar string holder 50 that is designed for mounting within the sound hole of the guitar. The guitar string holder 50 has hooks 52 extending laterally from supporting arms that can hold up to 12 strings. The arms extend from the body member 54. The body member 54 includes, at each end, a multilevel support member having a first contact support surface 56 and a second contact support surface 58. Guitars are frequently manufactured with support braces positioned adjacent the sound hole and beneath the guitar surface. The braces can be positioned on either side of the sound hold and can be positioned to extend parallel to each other or at an angle.

Figure 10:
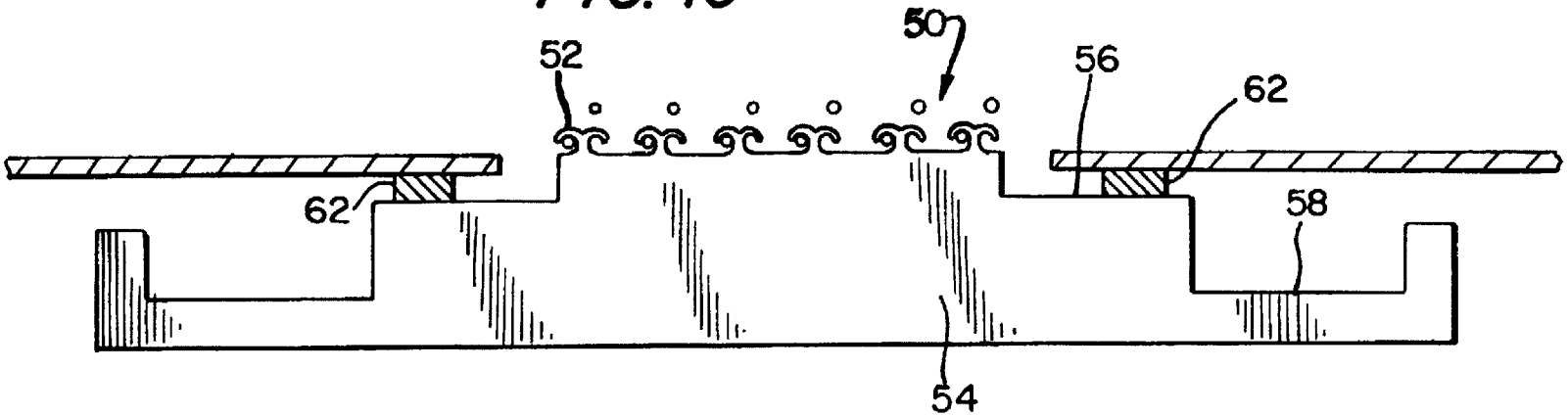
FIG. 10 shows an elevated view of a guitar string holder.
Figure 11:
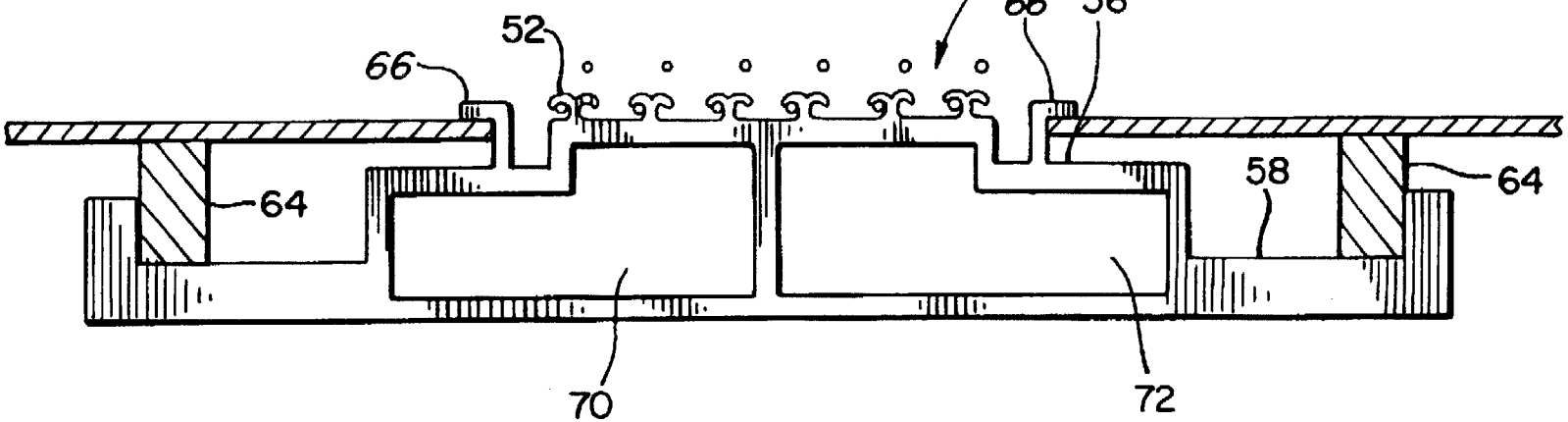
FIG. 11 shows another elevated view of an alternative embodiment of a guitar string holder.

The guitar string holder 50 can be inserted within the sound hole so that the first contact surfaces 56 can be positioned directly on a small brace 62. The musician can depress a string and hook it on a guitar string hook 52. The resilient force of the guitar string will hold the guitar string holder 50 against the small brace 62 as shown in FIG. 10. Alternatively, the same mounting procedure can be used to hold the guitar string holder 50 against a pair of larger braces 64 as shown in the embodiment of FIG. 11. FIG. 7 shows a plan view of the guitar string holder 50 mounted in a sound hole 50 of a guitar. The end posts 66 can be used to further wedge the guitar string holder 50 into position with brace members 64 that are positioned in an inclined manner to the longitudinal axis of the guitar.

In the embodiment of FIG. 11, support hooks 66 can be incorporated to further ensure a position about a sound hole. Additionally, the body member 68 can be extruded from metal such as aluminum with hollow central portions 70 and 72.

Figure 12:
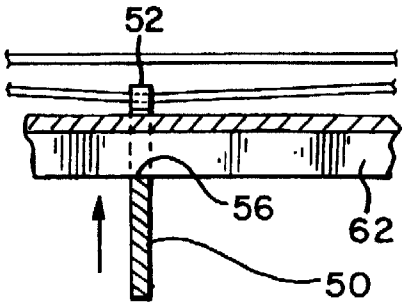
FIG. 12 shows a partial cross-section of the guitar string forcing the guitar string holder against a support base.

Thus, according to the presently preferred embodiment, no screws, slots, or channels are needed to securely hold the guitar string holder 50 in place. When the guitar string holder 50 is not holding down guitar strings, it must be removed from the sound hole 30. (Of course, in other embodiments, wood screws and/or channels may be used.) FIG. 12 discloses the force of a guitar string holding the guitar string holder 50 against a small brace 62 in the interior of a guitar.

It is also possible to have a guitar string holder permanently mounted to a solid top guitar such as shown in FIG. 5 at the time of manufacture. The guitar string holder could be mounted through a slot on the surface of the solid top guitar. Just below the surface of the solid top guitar is a rectangular brace, which adds rigidity to the guitar top surface and could distribute pressure applied to the surface by the guitar string holder. The guitar string holder is preferably secured to the rectangular brace via wood screws, which are inserted from the guitar string holder into the rectangular brace.

By using the guitar string holder of the present invention in its different embodiments, it is possible to convert, for example, a twelve-string guitar into a nine-string, a six-string, a Nashville, and a guitar with two separate tunings. The separate tunings can be accomplished by lowering the standard six-string guitar's strings into the guitar string holder of the present invention and tuning the octave strings to an open D, for example. Then the six-string guitar's strings are raised and the octave strings are lowered onto the guitar string holder. These six strings can then, in turn, be tuned to an open G, for example. As a result, one can have a Nashville guitar that could be pretuned to different open tunings. In effect, our present invention permits the duplication of guitars so that a performer would not need two separate guitars and can have a pretuned six-string guitar and a Nashville guitar from a standard twelve-string guitar.

Those skilled in the art will appreciate that various adaptations and modifications of the just-described preferred embodiment can be configured without departing from the scope and spirit of the invention. The guitar string holder of the present invention is not limited only to twelve-string guitars, but rather can be configured to accommodate any stringed instrument and to hold any combination of strings according to the preference of the musician. For example, the guitar string holder of the present invention can be used on twelve-string solid top guitars, twelve-string banjos, eight-string mandolins, and other twelve-string instruments. Therefore, it is to be understood that, within the scope of the appended claims, the invention may be practiced other than as specifically described herein.

What is claimed is:

1. A guitar string holder for effectively converting a twelve-string guitar with twelve strings into a six-string guitar or a Nashville guitar by lowering six of the twelve strings below an operative range of a user's pick or fingers, the guitar string holder comprising:

a base having a contacting surface for contacting a base-accommodation portion of the guitar, the base accommodating portion of the guitar being located near to an area where the user strums the guitar;

securing means for securing the base to the base-accommodating portion of the guitar;

six arms fixedly and integrally connected to the base, each of the six arms having a base portion near the base and a distal portion away from the base, each of the six arms extending away from the base of the string holder; and twelve hooks connected to the six distal portions of the corresponding six arms, each of the twelve hooks comprising a curved portion that curves from a first direction which is generally parallel to a corresponding one of the six arms to a second direction which points back to the base of the guitar, each of the twelve hooks capable of holding a corresponding one of the strings below the operative range of the user's pick.

2. The guitar string holder according to claim 1, wherein the contacting surface is a bottom planar surface of the base.

3. The guitar string holder according to claim 2, wherein the base-accommodating portion is a planar surface beneath the guitar strings and near the sound hole.

4. The guitar string holder according to claim 3, wherein the securing means comprises apertures in the base and wood screws fitting into the apertures and into the body.

5. The guitar string holder according to claim 1, wherein the contacting surface is near opposing ends of base.

6. The guitar string holder according to claim 5, wherein the base-accommodating portion comprises two areas on an edge of the sound hole.

7. The guitar string holder according to claim 6, wherein the securing means comprises channels at opposing ends of the base for fitting around the two areas on the edge of the sound hole.

8. The guitar string holder according to claim 1, wherein a width between each of the hooks is approximately two times as large as a width between any two adjacent strings of the twelve strings of the twelve-string guitar.

9. The guitar string holder according to claim 8, wherein the widths between the hooks correspond to widths between alternative strings of the twelve-string guitar.

10. The guitar string holder according to claim 1, wherein a part of each curved portion of each of the hooks is generally parallel to the base of the guitar string holder.

11. The guitar string holder according to claim 10, wherein the parallel part of each curved portion of each of the hooks applies a force to each of the depressed strings, each applied force being normal to the base of the guitar string holder.

12. The guitar string holder according to claim 11, wherein each applied force is in a direction from the hook to the base of the guitar string holder.

13. A guitar, comprising:

a neck having a plurality of keys at a distal end thereof; the plurality of keys holding a corresponding plurality of guitar strings at first ends of the guitar strings, the neck further having frets located thereon for allowing a user to press the guitar strings against the frets to decrease or increase speaking lengths of the guitar strings;

a body having a tail piece for holding the guitar strings at second ends of the guitar strings, the body further having a bridge for separating the guitar strings from one another and elevating the guitar strings to an operative plane above the body;

a sound hole located on the body beneath a section of the guitar strings, the sound hole comprising a generally circular opening which allows sound from vibrating guitar strings to enter the body and reverberate; and a guitar string assembly positioned on the body approximately adjacent to the sound hole, including a first and second guitar string holder, the guitar string holders being secured adjacent to each other and to the body beneath the operative plane, and comprising a plurality of hooks for holding a plurality of the guitar strings beneath the operative plane.

14. The guitar according to claim 13, wherein the guitar string holders comprises six hooks for holding six guitar strings below the operative plane to thereby effectively convert a twelve-string guitar into a six-string guitar.

15. A guitar string holder for effectively converting a twelve-string guitar having support braces with twelve strings into a six-string guitar or a Nashville guitar by lowering six of the twelve strings below an operative range of a user's pick or fingers, the guitar string holder comprising:

a base the guitar having for contacting an inner side of a top surface of a guitar, the inner side being located near a sound hole of the guitar;

a plurality of hooks extending in a direction from the base of the guitar string holder to the sound hole, the plurality of hooks selectively holding corresponding strings of the guitar; and a support member positioned at respective ends of the base for removably contacting the guitar and holding the guitar string holder including a brace contacting surface, whereby the resilient force of a guitar string held by a hook will maintain the brace contacting surface against the support brace, the respective dimensions of the hooks and support members position the support members beneath the top surface of a guitar with the hooks below the operative range of the user's pick or fingers wherein the strings of the guitar pull the guitar string holder against an inner side of the surface of a guitar to thereby hold the guitar string holder in place.

16. The guitar string holder of claim 15, wherein the inner side of the guitar comprises braces, which are contacted by the base of the guitar string holder.

17. A one-piece guitar string holder for modifying a twelve-string guitar into a lesser string guitar consisting of:

a rectangular base member having a planar bottom surface capable of being positioned on a guitar surface; and a plurality of arms integrally attached to a top surface of the rectangular base member and extending upward from the top surface;

a pair of hooks integrally attached to a top of each arm to form a gull-wing cross-sectional configuration whereby each hook can hold a guitar string below the operative range of a user's pick.

18. A guitar string holder for modifying a multi-string guitar into a lesser string guitar, the multi-string guitar having a top surface with a sound hole, comprising:

a body member having a central series of arms extending from the body member;

multi-level support members extend from each side of the central series of arms and include a first and second contact surface dimensioned relative to the position of the arms to contact support braces positioned adjacent a sound hole and beneath the top guitar surface, while placing the arms adjacent and below strings when mounted in a guitar; and at least one hook integrally attached to each arm and capable of holding a guitar string below an operative range of a user's pick, the resilient force of a guitar string held by a hook will maintain a contact surface against a support brace, the respective dimensions of the hooks and support members position the support members beneath the top surface of the guitar with the hooks below the operative range of the user's pick or fingers wherein the strings of the guitar, when engaged with a hook, can exert a force that would pull the guitar string holder against an inner side of the top surface of the guitar to thereby hold the guitar string holder in place.

19. The guitar string holder of claim 18, wherein the body member, arms, multi-level support members and hooks are integrally extruded as a flat plate whereby the insertion of the flat plate into a sound hole and the attachment of one or more hooks to strings can releasably mount the guitar string holder in a multi-string guitar without additional fasteners.

20. The guitar string holder of claim 19, wherein a pair of hooks are integrally attached to each arm and provide a gull-wing cross-sectional configuration.

* * * * *